US010436491B2

(12) United States Patent
Popli et al.

(10) Patent No.: US 10,436,491 B2
(45) Date of Patent: Oct. 8, 2019

(54) SYSTEM AND METHOD OF CONTROLLING A VARIABLE-CAPACITY COMPRESSOR

(71) Applicant: Emerson Climate Technologies, Inc., Sidney, OH (US)

(72) Inventors: Sahil Popli, Silver Spring, MD (US); Edward J. Trudeau, Jr., Covington, OH (US); Hung M. Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 16/193,310

(22) Filed: Nov. 16, 2018

(65) Prior Publication Data

US 2019/0086133 A1 Mar. 21, 2019

Related U.S. Application Data

(63) Continuation of application No. 15/651,942, filed on Jul. 17, 2017, now Pat. No. 10,132,543, which is a (Continued)

(51) Int. Cl.
*F25B 49/02* (2006.01)
*F24F 11/30* (2018.01)
(Continued)

(52) U.S. Cl.
CPC ..... *F25B 49/022* (2013.01); *F24F 11/30* (2018.01); *F24F 11/86* (2018.01); *F24F 2110/10* (2018.01);
(Continued)

(58) Field of Classification Search
CPC ..... F24F 11/0012; F24F 3022/0013; F24F 11/0015; F24F 2011/0016;
(Continued)

(56) References Cited

U.S. PATENT DOCUMENTS 4,228,846 A 10/1980 Smorol
4,257,238 A 3/1981 Kountz et al.
(Continued)

FOREIGN PATENT DOCUMENTS

AU 744608 B2 2/2002
CN 1239211 A 12/1999
(Continued)

OTHER PUBLICATIONS

U.S. Appl. No. 16/266,932, filed Feb. 4, 2019, Sahil Popli et al.
(Continued)

*Primary Examiner* — Elizabeth J Martin
(74) *Attorney, Agent, or Firm* — Harness, Dickey & Pierce, P.L.C.

(57) ABSTRACT

A climate-control system includes a variable-capacity compressor unit and a control module. The variable-capacity compressor unit is operable in a first capacity mode and in a second capacity mode that is higher than the first capacity mode. The control module may be configured to switch the variable-capacity compressor unit between the first capacity mode and the second capacity mode based on a demand signal, a current outdoor air temperature, an outdoor-air-temperature slope, and a previous runtime of the variable-capacity compressor unit in the second capacity mode.

20 Claims, 8 Drawing Sheets

Related U.S. Application Data continuation of application No. 15/138,551, filed on Apr. 26, 2016, now Pat. No. 9,709,311.

(60) Provisional application No. 62/153,209, filed on Apr. 27, 2015.

(51) Int. Cl.

| | |
|---|---|
| ***F24F 11/86*** | (2018.01) |
| ***F25B 1/10*** | (2006.01) |
| ***F25B 13/00*** | (2006.01) |
| ***F24F 110/10*** | (2018.01) |
| ***F24F 110/12*** | (2018.01) |
| ***F24F 140/50*** | (2018.01) |

(52) U.S. Cl.

CPC ..... *F24F 2110/12* (2018.01); *F24F 2140/50* (2018.01); *F25B 1/10* (2013.01); *F25B 13/00* (2013.01); *F25B 2400/075* (2013.01); *F25B 2500/19* (2013.01); *F25B 2600/01* (2013.01); *F25B 2700/2106* (2013.01)

(58) Field of Classification Search

CPC .... F24F 2011/0013; F24F 11/86; F24F 11/30; F24F 2140/50; F24F 2110/10; F25B 49/022; F25B 1/10; F25B 13/00; F25B 2400/075; F25B 2500/19; F25B 2600/01; F25B 2700/2106

See application file for complete search history.

(56) References Cited

U.S. PATENT DOCUMENTS

| | | | |
|---|---|---|---|
| 5,062,276 | A | 11/1991 | Dudley |
| 5,129,234 | A | 7/1992 | Alford |
| 5,381,669 | A | 1/1995 | Bahel et al. |
| 5,385,453 | A | 1/1995 | Fogt et al. |
| 6,213,731 | B1 | 4/2001 | Doepker et al. |
| 6,293,116 | B1 | 9/2001 | Forrest et al. |
| 6,318,101 | B1 | 11/2001 | Pham et al. |
| 6,450,409 | B1 | 9/2002 | Rowlette et al. |
| 6,578,373 | B1 | 6/2003 | Barbier |
| 6,679,072 | B2 | 1/2004 | Pham et al. |
| 7,752,854 | B2 | 7/2010 | Singh et al. |
| 7,845,179 | B2 | 12/2010 | Singh et al. |
| 8,011,199 | B1 | 9/2011 | Chen et al. |
| 8,209,073 | B2 | 6/2012 | Wijaya et al. |
| 8,418,483 | B2 | 4/2013 | McSweeney et al. |
| 8,459,053 | B2 | 6/2013 | Pham et al. |
| 8,485,789 | B2 | 7/2013 | Gu et al. |
| 8,538,587 | B2 | 9/2013 | Hess et al. |
| 8,585,382 | B2 | 11/2013 | Akei et al. |
| 8,616,014 | B2 | 12/2013 | Stover et al. |
| 8,863,536 | B1 | 10/2014 | Perry et al. |
| 9,194,393 | B2 | 11/2015 | Pham |
| 9,562,710 | B2 | 2/2017 | Pham et al. |
| 9,709,311 | B2 | 7/2017 | Popli et al. |
| 2003/0033823 | A1 | 2/2003 | Pham et al. |
| 2003/0156946 | A1 | 8/2003 | Tolbert |
| 2005/0155369 | A1 | 7/2005 | Ootori et al. |
| 2005/0257538 | A1 | 11/2005 | Hwang et al. |
| 2006/0032253 | A1 | 2/2006 | Lee et al. |
| 2006/0037332 | A1 | 2/2006 | Hwang et al. |
| 2006/0156749 | A1 | 7/2006 | Lee et al. |
| 2006/0260334 | A1 | 11/2006 | Carey et al. |
| 2006/0280627 | A1 | 12/2006 | Jayanth |
| 2007/0012052 | A1 | 1/2007 | Butler et al. |
| 2007/0032909 | A1 | 2/2007 | Tolbert et al. |
| 2007/0079620 | A1 | 4/2007 | Lee |
| 2007/0151267 | A1 | 7/2007 | Hatano et al. |
| 2008/0135635 | A1 | 6/2008 | Deng et al. |
| 2008/0286118 | A1 | 11/2008 | Gu et al. |
| 2009/0159716 | A1 | 6/2009 | Kim |
| 2010/0064714 | A1 | 3/2010 | Tashiro |
| 2010/0082162 | A1 | 4/2010 | Mundy et al. |
| 2010/0107668 | A1 | 5/2010 | Voorhis et al. |
| 2010/0179703 | A1 | 7/2010 | Singh et al. |
| 2010/0218527 | A1 | 9/2010 | Kitagishi et al. |
| 2010/0268397 | A1 | 10/2010 | Whitehurst et al. |
| 2010/0275628 | A1 | 11/2010 | Moseley |
| 2010/0314458 | A1 | 12/2010 | Votaw et al. |
| 2011/0014890 | A1 | 1/2011 | Ajram et al. |
| 2012/0090337 | A1 | 4/2012 | Chen et al. |
| 2012/0185728 | A1 | 7/2012 | Guo et al. |
| 2012/0297805 | A1 | 11/2012 | Kamada et al. |
| 2012/0318007 | A1 | 12/2012 | Lukasse et al. |
| 2014/0033746 | A1 | 2/2014 | McSweeney |
| 2014/0262134 | A1 | 9/2014 | Arensmeier et al. |
| 2015/0219356 | A1 | 8/2015 | Ito et al. |
| 2016/0313039 | A1 | 10/2016 | Popli et al. |
| 2016/0313040 | A1 | 10/2016 | Trudeau et al. |
| 2016/0313042 | A1 | 10/2016 | Popli et al. |
| 2017/0268812 | A1 | 9/2017 | Trudeau et al. |
| 2017/0343230 | A1 | 11/2017 | Popli et al. |
| 2017/0350633 | A1 | 12/2017 | Popli et al. |
| 2019/0170417 | A1 | 6/2019 | Popli et al. |

FOREIGN PATENT DOCUMENTS

| | | | |
|---|---|---|---|
| CN | 1291702 | A | 4/2001 |
| CN | 1482408 | A | 3/2004 |
| CN | 1517624 | A | 8/2004 |
| CN | 1699865 | A | 11/2005 |
| CN | 1796879 | A | 7/2006 |
| CN | 1873352 | A | 12/2006 |
| CN | 1991173 | A | 7/2007 |
| CN | 101109553 | A | 1/2008 |
| CN | 101137873 | A | 3/2008 |
| CN | 101464022 | A | 6/2009 |
| CN | 103216910 | A | 7/2013 |
| EP | 1398576 | A2 | 3/2004 |
| EP | 1684025 | A1 | 7/2006 |
| EP | 2050958 | A1 | 4/2009 |
| EP | 2443403 | A1 | 4/2012 |
| EP | 2772699 | A1 | 9/2014 |
| JP | H03160261 | A | 7/1991 |
| JP | H09318140 | A | 12/1997 |
| JP | 2745836 | B2 | 4/1998 |
| KR | 100715999 | B1 | 5/2007 |
| KR | 20070071090 | A | 7/2007 |
| KR | 20080089967 | A | 10/2008 |
| KR | 20100059522 | A | 6/2010 |
| KR | 20130033847 | A | 4/2013 |
| WO | WO-2007130051 | A1 | 11/2007 |
| WO | WO-2009061301 | A1 | 5/2009 |
| WO | WO-2013149210 | A1 | 10/2013 |
| WO | WO-2014017316 | A1 | 1/2014 |
| WO | WO-2015153766 | A1 | 10/2015 |

OTHER PUBLICATIONS

International Search Report regarding International Application No. PCT/US2016/029543, dated Aug. 9, 2016.

Written Opinion of the International Searching Authority regarding International Application No. PCT/US2016/029543, dated Aug. 9, 2016.

International Search Report regarding International Application No. PCT/US2016/029588, dated Aug. 9, 2016.

Written Opinion of the International Searching Authority regarding International Application No. PCT/US2016/029588, dated Aug. 9, 2016.

International Search Report regarding International Application No. PCT/US2016/029593, dated Aug. 10, 2016.

Written Opinion of the International Searching Authority regarding International Application No. PCT/US2016/029593, dated Aug. 10, 2016.

International Search Report regarding International Application No. PCT/US2016/029536, dated Sep. 12, 2016.

Written Opinion of the International Searching Authority regarding International Application No. PCT/US2016/029536, dated Sep. 12, 2016.

(56) References Cited

OTHER PUBLICATIONS

Notice of Allowance regarding U.S. Appl. No. 15/138,551, dated May 25, 2017.
International Search Report regarding International Application No. PCT/US2017/022563, dated Jun. 26, 2017.
Written Opinion of the International Searching Authority regarding International Application No. PCT/US2017/022563, dated Jun. 26, 2017.
International Search Report regarding International Application No. PCT/US2017/034510, dated Aug. 28, 2017.
Written Opinion of the International Searching Authority regarding International Application No. PCT/US2017/034510, dated Aug. 28, 2017.
Office Action regarding U.S. Appl. No. 15/138,771, dated Jun. 5, 2018.
Notice of Allowance regarding U.S. Appl. No. 15/138,981, dated Jul. 2, 2018.
Notice of Allowance regarding U.S. Appl. No. 15/651,942, dated Jul. 9, 2018.
Office Action regarding U.S. Appl. No. 15/457,418, dated Jul. 26, 2018.
Notice of Allowance regarding U.S. Appl. No. 15/651,942, dated Aug. 16, 2018.
Applicant-Initiated Interview Summary regarding U.S. Appl. No. 15/457,418, dated Oct. 2, 2018.
Notice of Allowance regarding U.S. Appl. No. 15/457,418, dated Feb. 7, 2019.
Office Action regarding Indian Patent Application No. 201621018358, dated Mar. 27, 2019.
Search Report regarding European Patent Application No. 16787055.9, dated Mar. 27, 2019.
Office Action regarding U.S. Appl. No. 15/138,771, dated Apr. 18, 2019.
Notice of Allowance regarding U.S. Appl. No. 15/457,418, dated May 1, 2019.
Office Action regarding Chinese Patent Application No. 201680030841.4, dated Jun. 24, 2019.
Office Action regarding Chinese Patent Application No. 201680031951.2, dated Jul. 3, 2019.
Office Action regarding Chinese Patent Application No. 201680032857.9, dated Jul. 3, 2019.

345

347

347

| OAT (°F) | BASELINE T1 | OVERRIDE T1 |
|---|---|---|
| >90 | 5 seconds | If $T2_{n-1}$>5min, then $T1_n$=5sec, else $T1_n$=40min |
| 85-90 | 30 minutes | If $T2_{n-1}$>5min, then $T1_n$=5sec, else $T1_n$=40min |
| 80-85 | 35 minutes | Not applicable. See Baseline T1 Column. |
| 75-80 | 40 minutes | Not applicable. See Baseline T1 Column. |
| 70-75 | 50 minutes | Not applicable. See Baseline T1 Column. |
| 65-60 | 60 minutes | Not applicable. See Baseline T1 Column. |
| 60-65 | 60 minutes | Not applicable. See Baseline T1 Column. |
| 55-60 | 50 minutes | Not applicable. See Baseline T1 Column. |
| 50-55 | 40 minutes | Not applicable. See Baseline T1 Column. |
| 45-50 | 40 minutes | Not applicable. See Baseline T1 Column. |
| 40-45 | 30 minutes | If $T2_{n-1}$>5min, then $T1_n$=5sec, else $T1_n$=20min |
| <40 | 5 seconds | If $T2_{n-1}$>5min, then $T1_n$=5sec, else $T1_n$=20min |

FIG. 3

445

| OAT (°F) | BASELINE T1 (446) | POSITIVE OAT SLOPE (447) | NEGATIVE OAT SLOPE (448) | EXTREME NEGATIVE OAT SLOPE (449) |
|---|---|---|---|---|
| >90 | 30 minutes | If $T2_{n-1}$ > 5min, then $T1_n$ = 5sec, else $T1_n$ = 30min | If $T2_{n-1}$ > 5min, then $T1_n$ = 5sec, else $T1_n$ = 25min | $T1_n$ = 2min |
| 85-90 | 30 minutes | If $T2_{n-1}$ > 5min, then $T1_n$ = 5sec, else $T1_n$ = 50min | If $T2_{n-1}$ > 5min, then $T1_n$ = 5sec, else $T1_n$ = 25min | $T1_n$ = 4min |
| 80-85 | 40 minutes | If $T2_{n-1}$ > 5min, then $T1_n$ = 5sec, else $T1_n$ = 55min | If $T2_{n-1}$ > 5min, then $T1_n$ = 5sec, else $T1_n$ = 30min | $T1_n$ = 8min |
| 75-80 | 40 minutes | If $T2_{n-1}$ > 10min, then $T1_n$ = 5sec, else $T1_n$ = 60min | If $T2_{n-1}$ > 10min, then $T1_n$ = 5sec, else $T1_n$ = 40min | $T1_n$ = 10min |
| 45-75 | 60 minutes | T1 = 60 | T1 = 60 | $T1_n$ = 10min |
| 35-45 | 40 minutes | If $T2_{n-1}$ > 5min, then $T1_n$ = 5sec, else $T1_n$ = 30min | If $T2_{n-1}$ > 5min, then $T1_n$ = 5sec, else $T1_n$ = 40min | Not Applicable. See Negative OAT Slope Column |
| 30-35 | 30 minutes | If $T2_{n-1}$ > 5min, then $T1_n$ = 5sec, else $T1_n$ = 20min | If $T2_{n-1}$ > 5min, then $T1_n$ = 5sec, else $T1_n$ = 40min | |
| <30 | 20 minutes | If $T2_{n-1}$ > 5min, then $T1_n$ = 5sec, else $T1_n$ = 15min | If $T2_{n-1}$ > 5min, then $T1_n$ = 5sec, else $T1_n$ = 20min | |

FIG. 4

| Region | Sensible Load (Temperature) | Latent Load (Humidity) | Indoor Blower Speed |
|---|---|---|---|
| Hot and Humid | Medium/low | High | Low |
| Very Hot/Dry | High | Low | High |
| Mixed-Mild | Medium/low | Low | Low/Medium |
| Mixed-Humid | Medium/low | Medium | Low |

FIG. 6

| **Region- Hot and Humid** | **12 AM to 6 AM** | **6 AM to 12 PM** | **12 PM to 6 PM** | **6 PM to 12AM** |
|---|---|---|---|---|
| Y1/Y2 setting | Y1 | More Y1 + Y2 | Y1 + more Y2 | Y1 + reducing Y2 |
| Ambient temperature Slope | Neutral | Positive | Reducing | Reducing/ Neutral |
| Sensible Load | Low | Low | Medium | Medium/Low |
| Latent Load | Medium | High | Very High | High |

FIG. 7

| **Region- Very Hot/Dry** | **12 AM to 6 AM** | **6 AM to 12 PM** | **12 PM to 6 PM** | **6 PM to 12AM** |
|---|---|---|---|---|
| Y1/Y2 setting | Y1 | More Y1 + Y2 | Y1 + more Y2 | Y1 + reducing Y2 |
| Ambient temperature Slope | Neutral | Positive | Reducing | Reducing/ Neutral |
| Sensible Load | Medium | Med/High | High | Med/Low |
| Latent Load | Low | | | |

FIG. 8

| **Region-Mixed-Mild** | **12 AM to 6 AM** | **6 AM to 12 PM** | **12 PM to 6 PM** | **6 PM to 12AM** |
|---|---|---|---|---|
| Y1/Y2 setting | Y1 | Y1 | Y1 + more Y2 | More Y1 + reducing Y2 |
| Ambient temperature Slope | Neutral | Positive | Reducing | Reducing/ Neutral |
| Sensible Load | Low | Low | Medium/High | Medium/Low |
| Latent Load | Low | | | |

FIG. 9

| Region- Hot and Humid | 12 AM to 6 AM | 6 AM to 12 PM | 12 PM to 6 PM | 6 PM to 12AM |
|---|---|---|---|---|
| Y1/Y2 setting | Y1 | More Y1 + Y2 | Y1 + more Y2 | Y1 |
| Ambient temperature Slope | Neutral | Positive | Reducing | Reducing/ Neutral |
| Sensible Load | Low | Low | Medium/High | Medium/Low |
| Latent Load | Low | Low | Medium | Medium/Low |

FIG. 10

SYSTEM AND METHOD OF CONTROLLING A VARIABLE-CAPACITY COMPRESSOR

CROSS-REFERENCE TO RELATED APPLICATIONS

This application is a continuation of U.S. patent application Ser. No. 15/651,942, filed on Jul. 17, 2017, which is a continuation of U.S. patent application Ser. No. 15/138,551, filed on Apr. 26, 2016, which claims the benefit of U.S. Provisional Application No. 62/153,209, filed on Apr. 27, 2015. The entire disclosures of each of the above applications are incorporated herein by reference.

FIELD

The present disclosure relates to a climate-control system having a variable-capacity compressor and to methods for controlling the climate-control system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Varying a capacity of the compressor can impact the energy-efficiency of the system and the speed with which the system is able to heat or cool a room or space.

SUMMARY

This section provides a general summary of the disclosure, and is not a comprehensive disclosure of its full scope or all of its features.

In one form, the present disclosure provides an outdoor unit for a climate-control system. The outdoor unit may include a variable-capacity compressor, an outdoor heat exchanger, and a control module. The variable-capacity compressor may be operable in a first capacity mode and in a second capacity mode that is higher than the first capacity mode. The outdoor heat exchanger may be in fluid communication with the compressor. The control module may control the compressor and may be configured to switch the compressor between the first capacity mode and the second capacity mode based on a demand signal and outdoor-air-temperature data.

In some configurations, the control module switches the compressor unit between the first and second capacity modes based on a compressor runtime.

In some configurations, the compressor runtime is a runtime of the compressor unit in the second capacity mode.

In some configurations, the runtime of the compressor unit in the second capacity mode is equal to a previous runtime in the second capacity mode during a previous demand period.

In some configurations, the control module switches the compressor unit between the first and second capacity modes based on an outdoor-air-temperature slope.

In some configurations, the control module determines which of first, second, third and fourth ranges the outdoor-air-temperature slope is within.

In some configurations, the control module sets a runtime of the compressor unit in the first capacity mode according to one of four columns in a lookup table based on which one of the first, second, third and fourth ranges the outdoor-air-temperature slope is within.

In some configurations, the first range is a neutral slope range and includes an outdoor-air-temperature slope of zero, the second range corresponds to a positive outdoor-air-temperature slope, the third range corresponds to a negative outdoor-air-temperature slope, and the fourth range corresponds to an extreme negative outdoor-air-temperature slope.

In some configurations, the outdoor-air-temperature data is obtained from an outdoor-air-temperature sensor.

In some configurations, the outdoor-air-temperature data is determined based on a heat exchanger coil temperature.

In another form, the present disclosure provides a climate-control system (e.g., a heat pump, air conditioning or refrigeration system) that may include a variable-capacity compressor unit and a control module controlling the compressor unit. The compressor unit may be operable in a first capacity mode and in a second capacity mode that is higher than the first capacity mode. The control module may be configured to switch the compressor unit between the first capacity mode and the second capacity mode based on a demand signal, a current outdoor air temperature, and an outdoor-air-temperature slope.

In some configurations, the control module switches the compressor unit between the first and second capacity modes based on a compressor runtime.

In some configurations, the compressor runtime is a runtime of the compressor unit in the second capacity mode.

In some configurations, the runtime of the compressor unit in the second capacity mode is equal to a previous runtime in the second capacity mode during a previous demand period.

In some configurations, the control module switches the compressor unit between the first and second capacity modes based on an outdoor-air-temperature slope.

In some configurations, the control module determines which of first, second, third and fourth ranges the outdoor-air-temperature slope is within.

In some configurations, the control module sets a runtime of the compressor unit in the first capacity mode according to one of four columns in a lookup table based on which one of the first, second, third and fourth ranges the outdoor-air-temperature slope is within.

In some configurations, the first range is a neutral slope range and includes an outdoor-air-temperature slope of zero, the second range corresponds to a positive outdoor-air-temperature slope, the third range corresponds to a negative outdoor-air-temperature slope, and the fourth range corresponds to an extreme negative outdoor-air-temperature slope.

In some configurations, the control module accounts for relative humidity based on the outdoor-air-temperature slope.

In some configurations, the control module accounts for a thermal load of a building to be heated or cooled by the climate-control system based on the outdoor-air-temperature slope.

In some configurations, the climate-control system includes an indoor blower forcing air over an indoor heat exchanger. The indoor blower may have a speed setting determined based on a region in which the climate-control system is installed.

In some configurations, the control module sets system operating parameters based on a region in which the climate control system is installed. The system operating parameters may include one or more of the following: a high-capacity runtime of the compressor unit, a low-capacity runtime of the compressor unit, and a fan (e.g., an indoor blower or an outdoor blower) speed.

In some configurations, the control module selects a region based on a comparison of outdoor-air-temperature values and outdoor-relative-humidity values with predetermined ranges of outdoor-air-temperature and outdoor-relative-humidity values.

In some configurations, the control module selects a region based on a comparison of user-selected indoor temperature setpoints with predetermined ranges of indoor temperature setpoints.

In another form, the present disclosure provides a climate-control system comprising a variable-capacity compressor unit and a control module controlling the compressor unit. The compressor unit may be operable in a first capacity mode and in a second capacity mode that is higher than the first capacity mode. The control module may be configured to switch the compressor unit between the first capacity mode and the second capacity mode based on a demand signal, outdoor-air-temperature data, and a time of day.

In some configurations, the control module approximates the time of day by determining an outdoor-air-temperature slope.

In another form, the present disclosure provides a method of controlling a compressor operable in a first capacity mode and in a second capacity mode that is higher than the first capacity mode. The method may include receiving a demand signal from a thermostat; obtaining an outdoor-air-temperature value; setting a first-capacity-runtime of the compressor in the first capacity mode based on the outdoor-air-temperature value; comparing a total runtime of the compressor to the first-capacity-runtime; and switching the compressor from the first capacity mode to the second capacity mode in response to the comparison of the total runtime and the first-capacity-runtime.

In some configurations, the first-capacity-runtime is set based on a previous second-capacity-runtime of the compressor in the second capacity mode.

In some configurations, the method includes determining an outdoor-air-temperature slope.

In some configurations, the method includes determining which of first, second, third and fourth ranges the outdoor-air-temperature slope is within.

In some configurations, the first-capacity-runtime is set according to one of four columns in a lookup table based on which one of the first, second, third and fourth ranges the outdoor-air-temperature slope is within.

In some configurations, the first range is a neutral slope range and includes an outdoor-air-temperature slope of zero, the second range corresponds to a positive outdoor-air-temperature slope, the third range corresponds to a negative outdoor-air-temperature slope, and the fourth range corresponds to an extreme negative outdoor-air-temperature slope.

In some configurations, determining an outdoor-air-temperature slope accounts for relative humidity based.

In some configurations, determining an outdoor-air-temperature slope accounts for a thermal load of a building to be heated or cooled.

In some configurations, the outdoor-air-temperature data is obtained from an outdoor-air-temperature sensor.

In some configurations, the outdoor-air-temperature data is determined based on a heat exchanger coil temperature.

In another form, the present disclosure provides a climate-control system that includes a variable-capacity compressor unit operable in a first capacity mode and in a second capacity mode that is higher than the first capacity mode and a control module. The control module is configured to (i) switch the variable-capacity compressor unit between the first capacity mode and the second capacity mode based on a demand signal, a current outdoor air temperature, and an outdoor-air-temperature slope, (ii) select a region based on a first comparison of at least one outdoor-air-temperature value with a predetermined outdoor-air-temperature range and a second comparison of at least one outdoor-relative-humidity value with a predetermined outdoor-relative-humidity range, and (iii) set at least one system operating parameter based on the selected region, the at least one system operating parameter including at least one of a high-capacity runtime of the variable-capacity compressor unit, a low-capacity runtime of the variable-capacity compressor unit, and a fan speed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 3 is a lookup table that can be used in the method and algorithm of FIG. 2;

FIG. 4 is another lookup table that can be used in the method and algorithm of FIG. 2;

FIG. 6 is a table illustrating relative sensible and latent loads for exemplary climate types;

FIG. 7 is a table providing data for a first climate type at various times of a day;

FIG. 8 is a table providing data for a second climate type at various times of a day;

FIG. 9 is a table providing data for a third climate type at various times of a day; and FIG. 10 is a table providing data for a fourth climate type at various times of a day.

Corresponding reference numerals indicate corresponding parts throughout the several views of the drawings.

DETAILED DESCRIPTION

Figure 1:
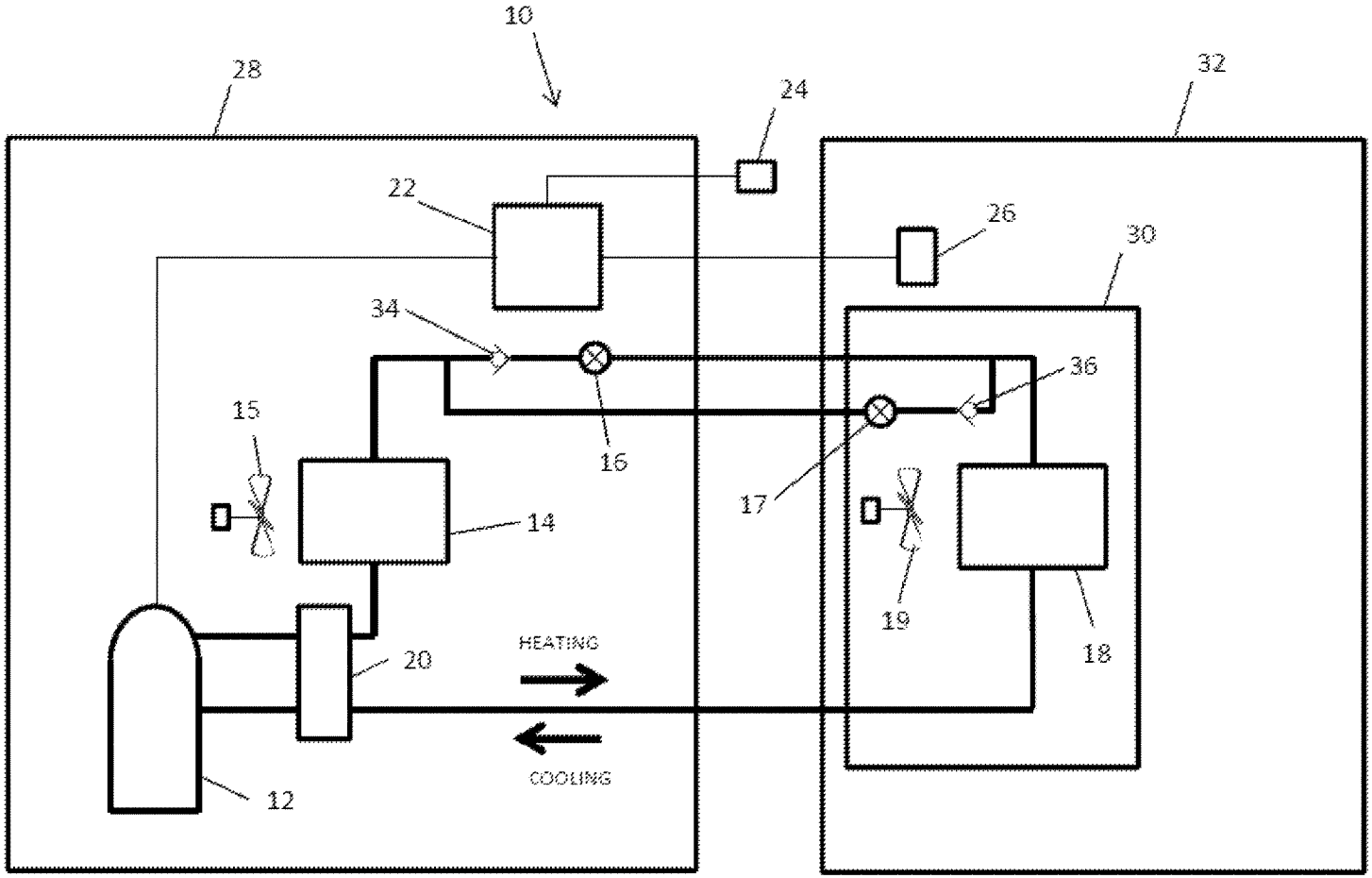
FIG. 1 is a schematic representation of a heat-pump system having a variable-capacity compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include a variable-capacity compressor (or a variable-capacity group of compressors) 12, an outdoor heat exchanger 14, an outdoor blower 15, a first expansion device 16, a second expansion device 17, an indoor heat exchanger 18, and an indoor blower 19. In the particular configuration shown in FIG. 1, the system 10 is a heat-pump system having a reversing valve 20 operable to control a direction of working fluid flow through the system 10 to switch the system 10 between a heating mode and a cooling mode. In some configurations, the system 10 may be an air-conditioning system or a refrigeration system, for example, and may be operable in only the cooling mode.

As will be described in more detail below, a controller or control module 22 may control operation of the compressor 12 and may switch the compressor 12 between a low-capacity mode and a high-capacity mode based on data received from an outdoor-air-temperature sensor 24, a signal received from a thermostat 26, a comparison between a runtime T of the compressor 12 and a predetermined low-capacity runtime T1, and/or a comparison between a previous high-capacity runtime T2 with a predetermined value. The control module 22 may minimize or reduce employment of high-capacity-mode operation to minimize or reduce energy usage while maintaining an acceptable level of comfort within a space to be heated or cooled.

The compressor 12 can be or include a scroll compressor, a reciprocating compressor, or a rotary vane compressor, for example, and/or any other type of compressor. The compressor 12 may be any type of variable-capacity compressor that is operable in at least a low-capacity mode and a high-capacity mode. For example, the compressor 12 may be or include a multi-stage compressor, a group of independently operable compressors, a multi-speed or variable-speed compressor (having a variable-speed or multi-speed motor), a compressor having modulated suction (e.g., blocked suction), a compressor having fluid-injection (e.g., an economizer circuit), a pulse-width-modulated scroll compressor configured for scroll separation (e.g., a digital scroll compressor), a compressor having variable-volume-ratio valves configured to leak intermediate-pressure working fluid, or a compressor having two or more of the above capacity modulation means. It will be appreciated that the compressor 12 could include any other additional or alternative structure for varying its capacity and/or the operating capacity of the system 10.

It will be appreciated that the low-capacity and/or high-capacity modes may be continuous, steady-state operating modes, or compressor 12 may be modulated (e.g., pulse-width-modulated) during operation in the low-capacity mode and/or during operation in the high-capacity mode. Exemplary variable-capacity compressors are disclosed in assignee's commonly owned U.S. Pat. No. 8,616,014, U.S. Pat. No. 6,679,072, U.S. Pat. No. 8,585,382, U.S. Pat. No. 6,213,731, U.S. Pat. No. 8,485,789, U.S. Pat. No. 8,459,053, and U.S. Pat. No. 5,385,453, the disclosures of which are hereby incorporated by reference.

The compressor 12, the outdoor heat exchanger 14, the outdoor blower 15, the first expansion device 16 and the reversing valve 20 may be disposed in an outdoor unit 28. The second expansion device 17, the indoor heat exchanger 18 and the indoor blower 19 may be disposed within an indoor unit 30 (e.g., an air handler or furnace) disposed within a home or other building 32. A first check valve 34 may be disposed between outdoor heat exchanger 14 and the first expansion device 16 and may restrict or prevent fluid flow through the first expansion device 16 in the cooling mode and may allow fluid flow through the first expansion device 16 in the heating mode. A second check valve 36 may be disposed between the second expansion device 17 and the indoor heat exchanger 18 and may restrict or prevent fluid flow through the second expansion device 17 in the heating mode and may allow fluid flow through the second expansion device 17 in the cooling mode.

The outdoor-air-temperature sensor 24 is disposed outside of the building 32 and within or outside of the outdoor unit 28 and is configured to measure an outdoor ambient air temperature and communicate the outdoor ambient air temperature value to the control module 22 intermittently, continuously or on-demand. In some configurations, the outside-air-temperature sensor 24 could be a thermometer or other sensor associated with a weather monitoring and/or weather reporting system or entity. In such configurations, the control module 22 may obtain the outdoor-air temperature (measured by the sensor 24) from the weather monitoring and/or weather reporting system or entity via, for example, an internet, Wi-Fi, Bluetooth®, Zigbee®, power-line carrier communication (PLCC), or cellular connection or any other wired or wireless communication protocol.

For example, the control module 22 may communicate with the weather monitoring and/or weather reporting system or entity over the internet via a Wi-Fi connection to a Wi-Fi router located in or associated with the building 32. The thermostat 26 is disposed inside of the building 32 and outside of the indoor unit 30 and is configured to measure an air temperature within a room or space to be cooled or heated by the system 10. The thermostat 26 can be a single-stage thermostat, for example, that generates only one type of demand signal in response to a temperature within the room or spaced rising above (in the cooling mode) or falling below (in the heating mode) a setpoint temperature. The control module 22 could be disposed in any suitable location, such as inside of or adjacent to the outdoor unit 28 or inside of or adjacent to the indoor unit 30, for example.

In the cooling mode, the outdoor heat exchanger 14 may operate as a condenser or as a gas cooler and may cool discharge-pressure working fluid received from the compressor 12 by transferring heat from the working fluid to air forced over the outdoor heat exchanger 14 by the outdoor blower 15, for example. The outdoor blower 15 could include a fixed-speed, multi-speed or variable-speed fan. In the cooling mode, the indoor heat exchanger 18 may operate as an evaporator in which the working fluid absorbs heat from air forced over the indoor heat exchanger 18 by the indoor blower 19 to cool a space within the home or building 32. The indoor blower 19 could include a fixed-speed, multi-speed or variable-speed fan. In the heating mode, the outdoor heat exchanger 14 may operate as an evaporator, and the indoor heat exchanger 18 may operate as a condenser or as a gas cooler and may transfer heat from working fluid discharged from the compressor 12 to a space to be heated.

Figure 2:
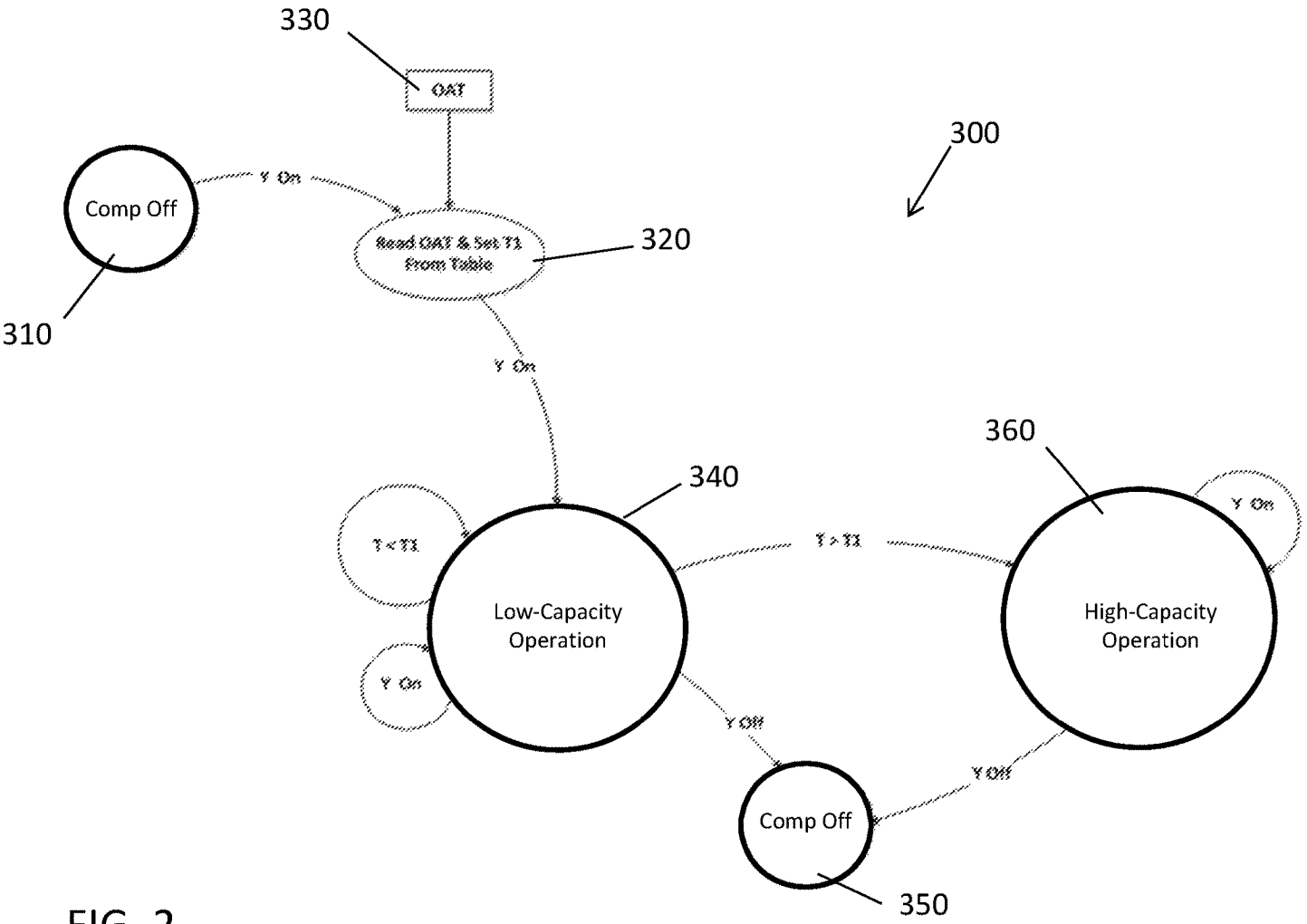
FIG. 2 is a state diagram illustrating another method and algorithm for controlling the variable-capacity compressor of FIG. 1.

Referring now to FIG. 2, a method and control algorithm 300 will be described that can be executed by the control module 22. The algorithm 300 may control operation of the compressor 12 and switch the compressor 12 between the low-capacity and high-capacity modes. In an initial state 310, the compressor 12 may be off. The thermostat 26 may send a demand signal Y to the control module 22 in response to an air temperature in the space to be heated or cooled by the system 10 dropping below (in the heating mode) or rising above (in the cooling mode) a selected setpoint temperature. In response to receipt of the demand signal Y, the control module 22 may initiate operation of the compressor 12 in the low-capacity mode (state 340) and simultaneously, at state 320, obtain an outdoor air temperature (e.g., from sensor 24 at input 330) and set a low-capacity runtime T1 based on data from table 345 (FIG. 3). Thereafter, the compressor 12 may continue to run in the low-capacity mode until the cooling demand is satisfied (i.e., the temperature in the space to be cooled drops below the selected setpoint temperature as indicated by the thermostat 26 and the thermostat switches the demand signal Y to "off"), until the total runtime T of the compressor 12 since the receipt of the demand signal Y surpasses the low-capacity runtime T1 set at state 320, or until the compressor 12 or system 10 is manually shutdown or a diagnostic or protection algorithm overrides the algorithm 300.

If demand is satisfied before the total runtime T reaches the predetermined low-capacity runtime T1, the control module 22 may shutdown the compressor 12 (state 350). If the compressor 12 has been running for longer than the predetermined low-capacity runtime T1 without satisfying the demand, the control module 22 may switch the compressor 12 from the low-capacity mode to the high-capacity mode (state 360). The compressor 12 may continue to run in the high-capacity mode until the cooling demand is satisfied (or until the compressor 12 or system 10 is manually shutdown or a diagnostic or protection algorithm overrides the algorithm 100). When demand is satisfied, the control module 22 may shutdown the compressor 12 (state 350). When the compressor 12 is shut down after satisfying demand by operating in the high-capacity mode, the control module 22 may record the runtime T2 of the compressor 12 in the high-capacity mode and store the high-capacity runtime T2 in a memory module associated with the control module 22.

As described above, FIG. 3 depicts the table 345 from which the control module 22 determines the low-capacity runtime T1. First, the control module 22 determines from which row of the table 345 to read based on the outdoor ambient temperature (OAT) value received at input 330. That is, the row of the table 345 from which the control module 22 reads is the row having an OAT range that includes the OAT value received at input 330. If the control module 22 has not received a demand signal Y from the thermostat 26 in a relatively long predetermined period of time (e.g., days, weeks or longer), the control module 22 may initially set the low-capacity runtime T1 at a default or baseline value listed in the Baseline T1 column at the corresponding OAT row of table 345.

With the low-capacity runtime T1 set at the baseline value corresponding to the OAT at the time of the initiation of the demand signal Y, the control module 22 may cause the compressor 12 to run in the low-capacity mode (state 340) until demand is met or until the compressor runtime T surpasses the set low-capacity runtime T1. If demand has not been met when the runtime T reaches the set low-capacity runtime T1, the control module 22 may switch the compressor 12 to the high-capacity mode (state 360). The compressor 12 may continue operating in the high-capacity mode until demand is met. Once demand is met, the controller 22 may record in the high-capacity runtime T2, as described above.

Upon receipt of a subsequent demand signal Y, the control module 22 may again determine a low-capacity runtime value T1 from the table 345.

This time, the control module 22 may determine if the OAT falls within one of a plurality of override ranges 347. For example, override ranges 347 in the cooling mode may include 85-90° F. and >90° F., and override ranges 347 in the heating mode may include 40-45° F. and <40° F. If the OAT value received at input 330 falls within one of the override ranges 347, the control module 22 may set the low-capacity runtime T1 at an override value determined by referencing the override T1 column at the corresponding OAT row.

The override value for the low-capacity runtime T1 may be determined based on a previous high-capacity runtime $T2_{n-1}$. For example, if the previous high-capacity runtime $T2_{n-1}$ is greater than a predetermine value (e.g., five minutes), the control module 22 may set the low-capacity runtime T1 to a first value (e.g., a short time period such as five seconds). If the previous high-capacity runtime $T2_{n-1}$ is less than the predetermine value (e.g., five minutes), the control module 22 may set the low-capacity runtime T1 to a second value (e.g., a longer time period such as twenty minutes or forty minutes). The control module 22 may then cause the compressor 12 to run in the low-capacity mode (state 340) until demand is met or until the compressor runtime T reaches the low-capacity runtime T1, at which time the control module 22 may switch the compressor to the high-capacity mode (state 360).

If the OAT falls within an OAT range that is not one of the override ranges 347, then the control module 22 will continue to set the low-capacity runtime T1 at the baseline value listed in the baseline T1 column. As described above, the control module 22 may cause the compressor 12 to run in the low-capacity mode until demand is met or until the compressor runtime T reaches the low-capacity runtime T1, at which time the control module 22 may switch the compressor 12 to the high-capacity mode until demand is met.

In another configuration, the algorithm 300 may include determining the low-capacity runtime T1 based on table 445 (FIG. 4) instead of table 345. As described above, the control module 22 may continuously or intermittently receive OAT data from the sensor 24 and may store the OAT data in a memory module. As described above, once the demand signal Y is received, the control module 22 may, at state 320, obtain the current OAT (e.g., from input 330) and set the low-capacity runtime T1 from the table 445.

If the control module 22 has not received a demand signal Y from the thermostat 26 in a relatively long predetermined period of time (e.g., days, weeks or longer), the control module 22 may initially set the low-capacity runtime T1 at a default or baseline value listed in Baseline T1 column 446 at the OAT row of table 445 that corresponds to the current OAT received at input 330. With the low-capacity runtime T1 set at the baseline value, the control module 22 may then cause the compressor 12 to operate in the low-capacity mode (state 340) until demand is met, or until the compressor runtime T reaches the set low-capacity runtime T1, at which time the control module 22 will run the compressor 12 in the high-capacity mode (state 360) until demand is met, in accordance with the algorithm 300 described above. The control module 22 may record the high-capacity runtime T2 for each run cycle of the compressor 12.

Upon receipt of a subsequent demand signal Y, the control module 22 may again determine a low-capacity runtime value T1 from the table 445. This time, the control module 22 may obtain the current OAT and determine a slope of the OAT over a predetermined time period (e.g., over the last twenty minutes, but may be any predetermined period of time that is suitably indicative of system conditions). If the OAT slope is within a neutral slope range (where the slope is greater than −0.3 degrees per 20 minutes and less than 0.3 degrees per 20 minutes, for example), then the control module 22 may set the low-capacity runtime T1 at the baseline value listed in the Baseline T1 column 446 at the OAT row of table 445 that corresponds to the current OAT. If the OAT slope is within a positive slope range (where the slope is greater than 0.3 degrees per 20 minutes, for example), then the control module 22 may set the low-capacity runtime T1 at the value listed in the Positive OAT Slope column 447 at the OAT row of table 445 that corresponds to the current OAT. If the OAT slope is within a first negative slope range (where the slope is less than −0.3 degrees per 20 minutes and greater than −0.6 degrees per 20 minutes, for example), then the control module 22 may set the low-capacity runtime T1 at the value listed in the Negative OAT Slope column 448 at the OAT row of table 445 that corresponds to the current OAT. If the OAT slope is within a second negative slope range (where the slope is less than −0.6 degrees per 20 minutes, for example), then the control module 22 may set the low-capacity runtime T1 at the value listed in the Extreme Negative OAT Slope column 449 at the OAT row of table 445 that corresponds to the current OAT.

While the OAT slope is described above as being determined over a predetermined time period, the OAT slope could also be determined by comparing OAT values at the beginning of a current compressor operating cycle (i.e., when the current demand signal Y is received) and at the end of the previous compressor operating cycle (i.e., when the last demand signal Y switched off). Still other methods for determining the OAT slope could be employed.

As shown in FIG. 4, some or all of the rows of column 447 and column 448 include steps for determining the low-capacity runtime T1 based on the previous high-capacity runtime $T2_{n-1}$ (i.e., the high-capacity runtime T2 of the previous run cycle in which the demand signal Y was constantly on or demand for heating or cooling was constantly present). For example, in the row of the Positive OAT Slope column 447 corresponding to an OAT of greater than 90° F.: if the previous high-capacity runtime $T2_{n-1}$ was greater than five minutes, then the current low-capacity runtime $T1_n$ should be set to five seconds; and if the previous high-capacity runtime $T2_{n-1}$ was less than or equal to five minutes, then the current low-capacity runtime $T1_n$ should be set to thirty minutes. As shown in FIG. 4, the above time and temperature values may vary for the various rows of columns 447 and 448.

Further, as shown in FIG. 4, the Extreme Negative OAT Slope column 449 may simply include predetermined values for each OAT range that may not be dependent upon a previous high-capacity runtime. In some configurations, the Extreme Negative OAT Slope column 449 may refer the algorithm to the Negative OAT Slope column 448 for colder OAT ranges (e.g., below 45° F.). For example, if the OAT slope is less than −0.6 degrees per 20 minutes and the current OAT is less than 45° F., the control module 22 may set the low-capacity runtime T1 in accordance with the Negative OAT Slope column 448.

After setting the low-capacity runtime T1 in accordance with table 445, the control module 22 may operate the compressor 12 in the low-capacity mode (state 340) until demand is met, or until the compressor runtime T reaches the set low-capacity runtime T1 (at which time the control module 22 will switch the compressor to the high-capacity mode until demand is met), in accordance with the algorithm 300 described above.

OAT slope is generally a good indicator or estimate of the time of day. Therefore, adjusting low-capacity and high-capacity runtimes based on OAT slope effectively adjusts low-capacity and high-capacity runtimes to account for the diurnal temperature profile. That is, during the course of a day, the OAT often changes according to a fairly standard profile. When the OAT is rising in the morning, the total compressor runtime T is typically shorter (during the cooling season) than when the OAT is falling in the evening because the house or building in which the system 10 is installed has accumulated a thermal load throughout the day that is still present in the evening. For the heating mode, the load shifts to early morning, i.e., more high-capacity runtime during positive slope periods or early morning part of day, and less low-capacity runtime during negative slope periods or evenings, since the house or building absorbs heat during the day. Therefore, adjusting the low-capacity and high-capacity runtimes based on OAT slope or time of day accounts for the thermal load on the house or building and increases comfort for the occupants. The real time could be determined by the control module 22 from an internal real-time clock, a thermostat real-time clock, a real-time clock accessed via an internet connection, or any other source.

Figure 5:
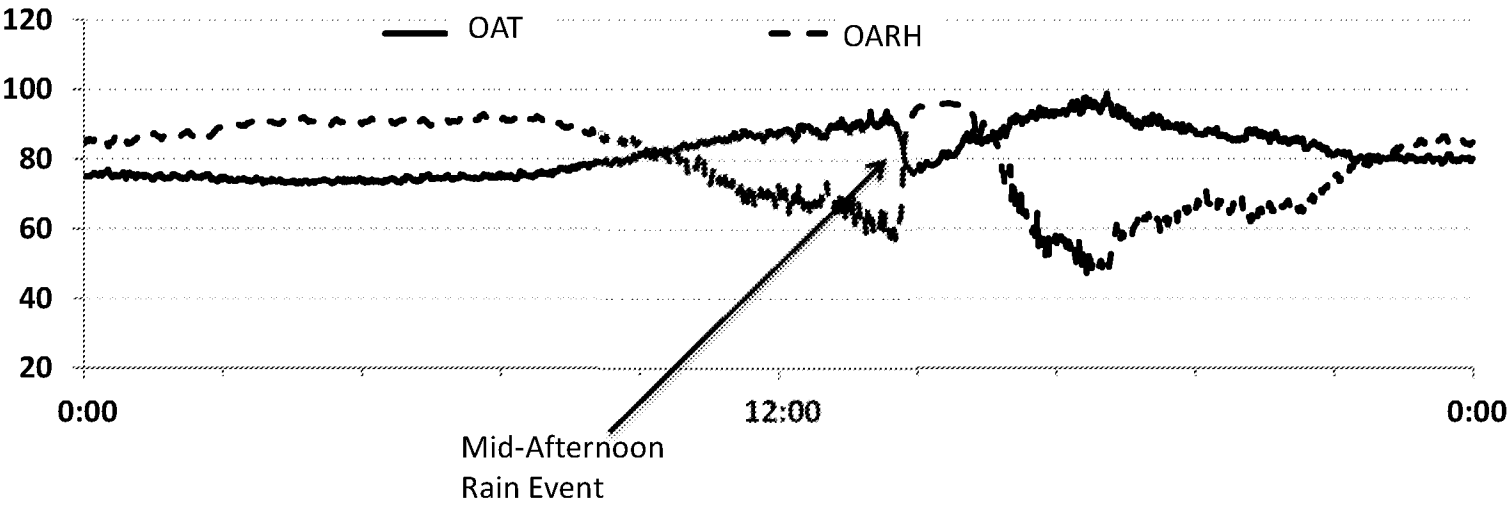
FIG. 5 is a graph depicting outdoor ambient temperature and outdoor ambient relative humidity versus time of day for an exemplary geographical location.

Furthermore, outdoor ambient relative humidity (OARH) often rises as OAT decreases and falls as OAT increases (as shown in FIG. 5). Therefore, OAT slope also indicates or approximates the slope of OARH. Thus, extreme negative OAT slopes (e.g., OAT slope less than −0.6 degrees per 20 minutes) can indicate an increased demand for dehumidification due to a mid-afternoon rain event, for example. Therefore, determining the OAT slope and adjusting low-capacity and high-capacity runtimes based on the OAT slope allows the algorithm 300 to account for the thermal load of the house or building and thermal load delay due to diurnal profile and allows the algorithm 300 to account for slope of ambient relative humidity without the use of a relative humidity sensor.

FIG. 5 depicts the OAT and OARH profile for a given day at a given location. As shown in FIG. 5, a mid-afternoon rain event can be accompanied by a sharp decrease in OAT and a corresponding sharp increase in OARH. Therefore, even though the OAT has decreased as a result of the rain event, demand for cooling may remain high due to the increased humidity and the possibility of OAT returning to its previous high before sunset. Therefore, such events having an extreme negative OAT slope are accounted for in table 445 (FIG. 4) at the Extreme Negative OAT Slope column 449, which assigns a very short low-capacity runtime T1 regardless of the length of any previous high-capacity runtime.

As described above, the indoor blower 19 (FIG. 1) could be a multi-speed blower that can be set at two or more speeds. Therefore, the system 10 may be operable in at least four different modes. In a first mode, the compressor 12 may operate in the low-capacity mode, and the indoor blower 19 may operate at a low speed. In a second mode, the compressor 12 may operate in the low-capacity mode, and the indoor blower 19 may operate at a high speed. In a third mode, the compressor 12 may operate in the high-capacity mode, and the indoor blower 19 may operate at the low speed. In a fourth mode, the compressor 12 may operate in the high-capacity mode, and the indoor blower 19 may operate at the high speed.

In some configurations, the speed of the indoor blower 19 may be set manually (e.g., by an installation contractor) and thereafter, the speed of the indoor blower 19 may be fixed at that speed. The speed of the indoor blower 19 could be selected based on the climate of the region (specifically, temperatures and humidity levels) in which the system 10 is installed. For example, as shown in FIG. 6, in regions with hot and humid climates (e.g., sub-tropical and tropical climates), the indoor blower 19 may be set to the low setting because lower indoor blower speeds are advantageous for faster dehumidification. In regions with very hot and dry climates (e.g., desert climates like the Southwest United States), the indoor blower 19 may be set to the high setting because higher indoor blower speeds are more advantageous for quickly reducing sensible heat. In regions with mixed temperatures and mild humidity, the indoor blower 19 may be set to the low or medium setting. In regions with mixed temperatures and higher humidity, the indoor blower 19 may be set to the low setting.

In the configurations in which the speed of the indoor blower 19 is set at installation and is fixed thereafter, the system 10 (having variable-capacity compressor 12) can be modulated between two modes: either between the first and third modes described above or between the second and fourth modes described above.

In other configurations, the control module 22 may be in communication with the indoor blower 19 and may be configured to modulate the speed of the indoor blower 19. In such configurations, the control module 22 may be configured to switch the system 10 among the first, second, third and fourth modes (i.e., by modulating the compressor 12 between the low-capacity and high-capacity modes and by modulating the indoor blower 19 between high and low speeds). The control module 22 may switch among the first, second, third and fourth modes depending on OAT, OAT slope, time of day (determined by the control module 22 from an internal real-time clock, a thermostat real-time clock, a real-time clock accessed via an internet connection, or any other source), low-capacity and high-capacity runtimes T1, T2, indoor relative humidity, outdoor relative humidity, historical weather data and/or forecasted weather data, for example.

It will be appreciated that the tables 345 and 445 and runtimes T1, T2 could also be adjusted based on the climate of the region in which the system 10 is installed. FIGS. 7-10 provide overviews of the exemplary regions of FIG. 6 including low-capacity/high-capacity (Y1/Y2) compressor runtime settings, OAT slopes, sensible loads and latent loads at various times of the day.

In some configurations, the control module 22 can be manually set to one of a plurality of climate regions. For example, an installation contractor can select the region by actuating a dip switch. As another example, a user could select the region in a setup menu of a thermostat (e.g., a Wi-Fi thermostat).

In some configurations, the control module 22 can learn the region in which the system 10 is installed based on actual outdoor weather conditions (e.g., OAT and OARH). The control module 22 may be programmed with predetermined ranges of OAT and OARH values that correspond to particular climate regions. The control module 22 may obtain on actual OAT and OARH values (e.g., from OAT and OARH sensors on or near the outdoor unit 28, through a Wi-Fi thermostat that acquires and provides weather data, or through an internet-provided weather data) and compare the actual OAT and OARH values to the predetermined ranges of OAT and OARH values to determine the region in which the system 10 is installed. Based on the comparison, the control module 22 can select one of the regions. The control module 22 may continuously or intermittently obtain and compare current OAT and OARH values with the predetermined ranges of values over a period of hours, days, weeks, months or years and may change the region setting based on those comparisons, as appropriate. As described above, the control module 22 can change the low-capacity and high-capacity runtimes, fan speeds and/or other operating parameters based on the region in which the system 10 is installed.

In addition to comparing current OAT and OARH values with the predetermined ranges of values, the control module 22 can also compare indoor temperature setpoints (i.e., thermostat setpoints selected by the user) with predetermined ranges or values to learn the region in which the system 10 is installed. Each region can be associated with a certain predetermined range of indoor temperature setpoints (e.g., users in the Southern United States tend to set their indoor temperature setpoints warmer (e.g., around 78 degrees Fahrenheit during summer months) than users in the Northern United States (e.g., who may set their indoor temperature setpoints to around 72 degrees Fahrenheit during summer months). This difference in indoor temperature setpoints may be due, in part, to acclimatization.

While OAT and OARH values are described above as being measured by an OAT sensor and OARH sensor, respectively, in some configurations, the control module 22 may obtain or determine OAT and/or OARH values directly or indirectly from one or more other measured and/or calculated parameters. For example, data from one or more of the following sensors could be used to determine or estimate OAT values: (i) defrost or outdoor coil temperature sensor (i.e., a sensor measuring a temperature of a coil of the outdoor heat exchanger 14), (ii) condensing pressure sensor, (iii) discharge line temperature or pressure sensor, (iii) suction line temperature or pressure sensor, (iv) compressor inlet temperature or pressure sensor, (v) indoor coil outlet temperature or pressure sensor, (vi) outdoor coil outlet temperature or pressure sensor, and (vii) outdoor coil liquid line temperature sensor.

During operation of the system 10 in a cooling mode or in a heating mode, OAT correlates well to outdoor and indoor coil temperatures. Therefore, OAT can be calculated or estimated based on a measured or calculated outdoor coil temperature or an indoor coil temperature. When the system 10 is operating in the heating mode (i.e., during the heating season), OAT may be greater than outdoor and indoor coil temperatures by known approximate amounts (e.g., about 5-20 degrees Fahrenheit depending on the location of the sensor along the coil and whether the compressor is operating in a low-capacity or high-capacity mode). When the system 10 is operating in the cooling mode (i.e., during the cooling season), OAT may be less than outdoor and indoor coil temperatures by known approximate amounts (e.g., about 5-20 degrees Fahrenheit depending on the location of the sensor along the coil and whether the compressor is operating in a low-capacity or high-capacity mode). The differences between OAT and coil temperatures may be less at or near the beginning of an operating cycle. The correlation between OAT and coil temperatures could be predetermined for a particular system and programmed into the control module 22.

It will be appreciated that coil temperatures can be calculated from quadratic or higher order polynomial functions of suction pressure or discharge pressure (depending on whether the system is operating in the heating or cooling mode).

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising a variable-capacity compressor unit and a control module controlling the compressor unit, the compressor unit operable in a first capacity mode and in a second capacity mode that is higher than the first capacity mode, the control module configured to switch the compressor unit between the first capacity mode and the second capacity mode based on a demand signal, an outdoor-air-temperature slope, and a previous runtime of the compressor unit in the second capacity mode during a previous demand period.

2. The climate-control system of claim 1, wherein the control module is configured to switch the compressor unit between the first capacity mode and the second capacity mode based a current outdoor air temperature.

3. The climate-control system of claim 1, wherein the control module determines which of first, second, third and fourth ranges the outdoor-air-temperature slope is within.

4. The climate-control system of claim 3, wherein the control module sets a runtime of the compressor unit in the first capacity mode according to one of four columns in a lookup table based on which one of the first, second, third and fourth ranges the outdoor-air-temperature slope is within.

5. The climate-control system of claim 4, wherein the first range includes an outdoor-air-temperature slope of zero, the second range corresponds to a positive outdoor-air-temperature slope, the third range corresponds to a negative outdoor-air-temperature slope, and the fourth range corresponds to an extreme negative outdoor-air-temperature slope.

6. The climate-control system of claim 1, wherein the control module accounts for relative humidity based on the outdoor-air-temperature slope.

7. The climate-control system of claim 1, wherein the control module accounts for a thermal load of a building to be heated or cooled by the climate-control system based on the outdoor-air-temperature slope.

8. The climate-control system of claim 1, further comprising an indoor blower forcing air over an indoor heat exchanger, the indoor blower having a speed setting determined based on a region in which the climate-control system is installed.

9. The climate-control system of claim 1, wherein the control module sets system operating parameters based on a region in which the climate-control system is installed, the system operating parameters including one or more of a runtime of the compressor unit in the second capacity mode, a runtime of the compressor unit in the first capacity mode, and a fan speed.

10. The climate-control system of claim 9, wherein the control module selects a region based on a comparison of outdoor-air-temperature values and outdoor-relative-humidity values with predetermined ranges of outdoor-air-temperature and outdoor-relative-humidity values.

11. The climate-control system of claim 9, wherein the control module selects a region based on a comparison of user-selected indoor temperature setpoints with predetermined ranges of indoor temperature setpoints.

12. A climate-control system comprising:

a variable-capacity compressor unit operable in a first capacity mode and in a second capacity mode that is higher than the first capacity mode; and a control module configured to switch the variable-capacity compressor unit between the first capacity mode and the second capacity mode based on a demand signal, a current outdoor air temperature, an outdoor-air-temperature slope, and a previous runtime of the compressor unit in the second capacity mode during a previous demand period.

13. The climate-control system of claim 12, wherein the control module is configured to set at least one system operating parameter based on a region in which the climate-control system is installed, wherein the at least one system operating parameter includes at least one of a runtime of the variable-capacity compressor unit in the first capacity mode, a runtime of the variable-capacity compressor unit in the second capacity mode, and a fan speed.

14. The climate-control system of claim 13, wherein the control module sets the at least one system operating parameter based on a time of day.

15. The climate-control system of claim 14, wherein the control module approximates the time of day by determining the outdoor-air-temperature slope.

16. The climate-control system of claim 13, wherein the control module determines which of first, second, third and fourth ranges the outdoor-air-temperature slope is within.

17. The climate-control system of claim 16, wherein the control module sets a runtime of the variable-capacity compressor unit in the first capacity mode according to one of four columns in a lookup table based on which one of the first, second, third and fourth ranges the outdoor-air-temperature slope is within.

18. The climate-control system of claim 17, wherein the first range includes an outdoor-air-temperature slope of zero, the second range corresponds to a positive outdoor-air-temperature slope, the third range corresponds to a negative outdoor-air-temperature slope, and the fourth range corresponds to an extreme negative outdoor-air-temperature slope.

19. The climate-control system of claim 18, wherein the control module accounts for relative humidity based on the outdoor-air-temperature slope.

20. The climate-control system of claim 19, wherein the control module accounts for a thermal load of a building to be heated or cooled by the climate-control system based on the outdoor-air-temperature slope.

* * * * *